United States Patent [19]

Souza et al.

[11] 4,023,840

[45] May 17, 1977

[54] LATCH ASSEMBLY

[75] Inventors: Anthony J. Souza, Lancaster; John M. Michel, Downingtown, both of Pa.

[73] Assignee: Woodstream Corporation, Pa.

[22] Filed: May 13, 1976

[21] Appl. No.: 685,748

[52] U.S. Cl. ..... 292/113; 292/66; 292/DIG. 38

[51] Int. Cl.[2] ..... E05C 19/12

[58] Field of Search ..... 292/113, 114, 66, 67, 292/DIG. 38, 256

[56] References Cited

UNITED STATES PATENTS

| | | | |
|---|---|---|---|
| 3,134,617 | 5/1964 | Slonneger | 292/3 |
| 3,181,905 | 5/1965 | Bisbing | 292/109 |
| 3,490,805 | 1/1970 | DiPerro | 292/258 |

*Primary Examiner*—Robert L. Wolfe

[57] ABSTRACT

A latch assembly for use with a tackle box or other container is disclosed. The latch assembly includes a latch top segment, a latch bottom segment and a receiver, all of which may be manufactured by injection molding. The latch assembly includes the feature that no separate pins or rivets are required either to assemble the components or to attach the latch assembly to the container with which it is employed.

2 Claims, 6 Drawing Figures

LATCH ASSEMBLY

The present invention to a latch assembly for use with tackle boxes and other containers. More particularly, the present invention relates to a latch assembly having components which may be manufactured completely by injection molding. The latch assembly of the present invention requires no separate rivets or pins to assemble the operating components and the present latch does not require a separate pin or pins to attach it to the tackle box or other container with which it is employed.

Previous latch assemblies for use with tackle boxes and other containers have typically required the use of one or more pins or rivets to assemble the latch for operation in connection with a container. Such prior art latch assemblies have been accompanied by various disadvantages, including difficulty of assembly and the misalignment or loss of the pin or rivet during use of the latch as installed upon the container.

By the present invention, there is provided an improved latch assembly, the components of which may be completely injection molded. The latch is of relatively simple construction, requireing no separate pins or rivets to assemble the operating members. Furthermore, the present latch assembly does not require a separate pin or rivet to attach it to the tackle box or other container.

BRIEF DESCRIPTION OF THE DRAWINGS

The advantages and features of the latch assembly of the present invention will be more fully understood from the following description of the preferred embodiments, taken in conjunction with the accompanying drawings, wherein.

DESCRIPTION OF THE PREFERRED EMBODIMENTS

Figure 1:
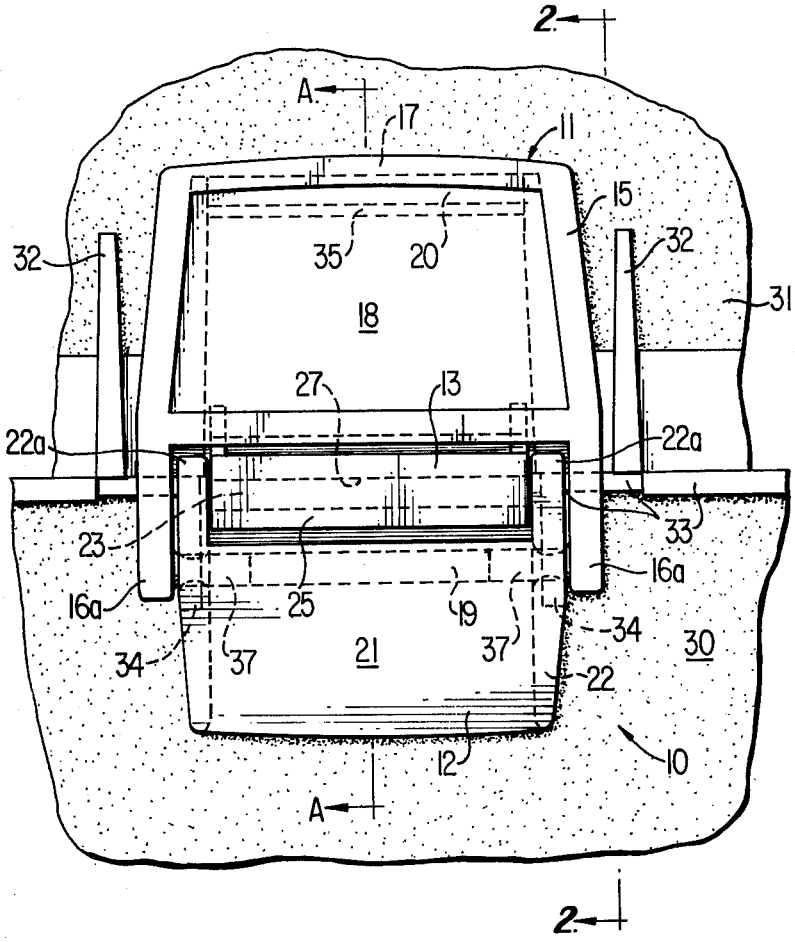
FIG. 1 is a front elevational view of the latch assembly of the present invention, as applied to a tackle box, for example, the parts being shown in their closed or locked positions.
Figure 2:
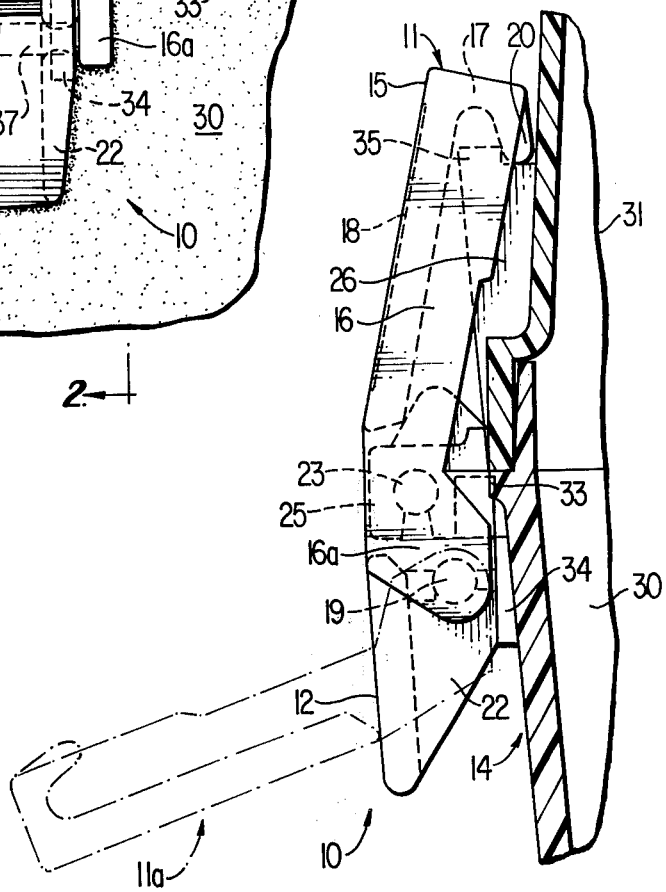
FIG. 2 is a side elevational view of the latch assembly shown in FIG. 1.
Figure 3:
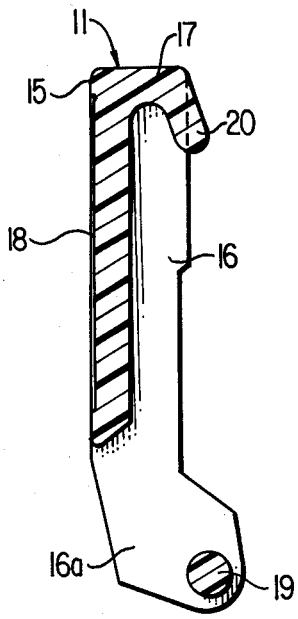
FIG. 3 is a vertical sectional view of the latch top segment, taken along line A—A of FIG. 1.
Figure 4:
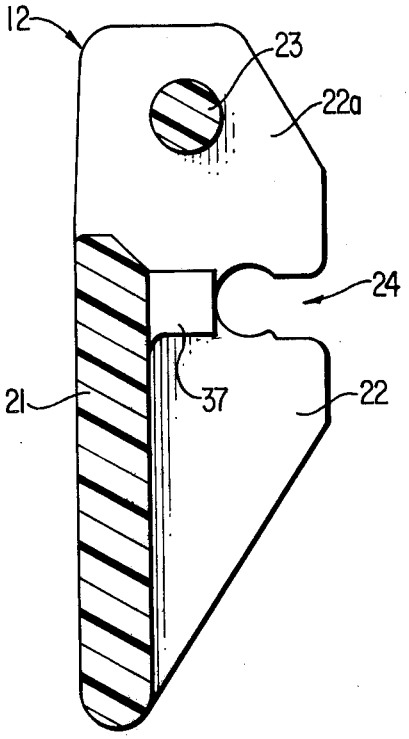
FIG. 4 is a vertical sectional view of the latch bottom segment taken along line A—A of FIG. 1.

In the embodiment of the present invention as illustrated in FIGS. 1 through 6, there is shown a latch assembly 10 which includes a latch top segment 11 and a latch bottom segment 12. A latch receiver 13 is provided as an integral component of a tackle box or other container 14 having side walls 30 and a hinged lid or cover 31, as shown in FIG. 2. A latch guard in the form of a vertical rib 32 may be attached to the lid 31 on either side of the latch top segment 11, while the wall 30 is provided with a projecting rib 33, as also shown in FIG. 2. The latch top segment 11 and the latch bottom segment 12, as well as the receiver 13, may be made by injection molding of a material such as polypropylene, having excellent durability when employed in molded articles, or other polymer having similar properties such as high density polyethylene.

The latch top segment 11 includes a planar base member 15, having attached thereto a pair of side flanges 16 and a top flange 17 which extend at right angles to the base 15. A longitudinal rib member 20 is attached to the top flange 17 and extends downwardly at an angle away from the base 15, the rib 20 being employed to releasably engage the container 14 when the latch assembly 10 is in the closed or latched position, as described in more detail hereinafter. The base 15 is provided with a sightly indented portion 18 which faciliates handling of the top segment 11 and imparts a finished appearance to the latch assembly 10.

The top segment 11 also includes a longitudinally extending pin member 19 which is attached to and has its ends molded integrally with lower extensions 16*a* of the side flang4es 16. The side flange extensions 16*a* extend beyond the base 15, sufficiently to allow clearance for the latch bottom segment 12 to pivot about its attachment to the pin member 19, as described hereinafter.

The latch bottom segment 12 includes a planar base member 21 having attached thereto a pair of side flanges 22 which extend at right angles to the base 21. The side flanges 22 include extensions 22*a* which extend upwardly beyond the base member 21 to a point of attachment with a longitudinally extending pin member 23 which has its end portions molded integrally with the side flange extensions 22*a*. At the midportion of the inner edge of each side flange 22 an arcuate slot 24 is provided, with these slots 24 being provided for the purpose of receiving the pin member 19 of the latch top segment 11. The slots 24 are shaped so as to encircle the pin 19 to an extent sufficient to hold it in place while being discontinuous to an extent sufficient to allow the pin 19 to be snapped in place within the slots 24. A short reinforcing rib 37 is provided adjacent each slot 24 to serve as a seat against which the pin member 19 abuts as it turns or rotates in operative engagement within the slots 24.

Figure 6:
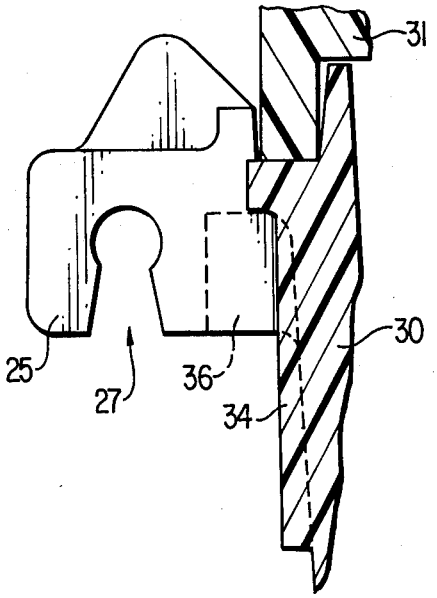
FIG. 6 is a vertical sectional view of the receiver taken along line B—B of FIG. 5.
Figure 5:
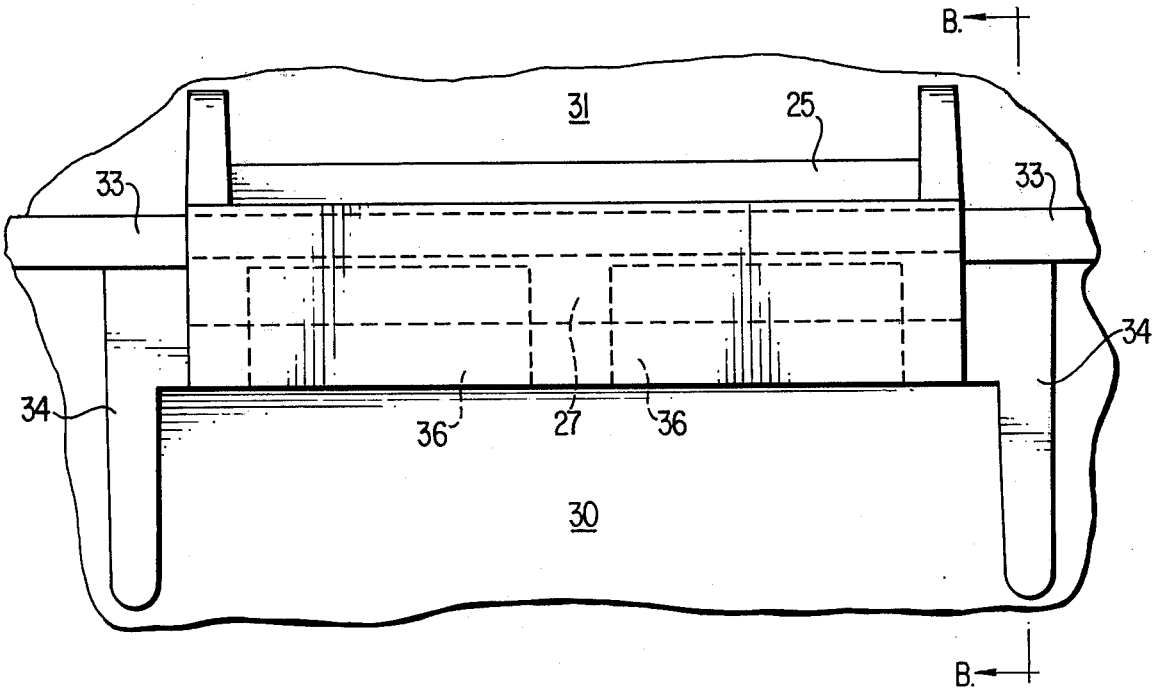
FIG. 5 is a front elevational view of a portion of the receiver employed with the present latch assembly.

In FIGS. 5 and 6, the latch top 11 and bottom 12 segments have been removed from the container 14 for purposes of illustrating the latch receiver 13. As shown in FIGS. 5 and 6, the latch receiver 13 includes a lower component 25 which is attached by means such as integral molding to the wall 30 of the container 14. The lower component 25 is provided with a longitudinally extending arcuate slot 27 which opens downwardly for the purpose of receiving the pin member 23 of the latch bottom segment 12. The slot 27 is shaped so as to encircle the pin 23 along its length to an extent sufficient to hold it in place while being discontinuous to an extent sufficient to allow the pin 23 to be snapped in place within the slot 27. A latch stop 34 is also molded into the wall 30 to serve as a member aginst which the latch bottom segment 12 may abut for additional support when in the closed position. In molding the lower component 25 to the wall 30, cavities 36 may be provided in that portion adjacent wall 30.

The upper component 26 of the latch receiver 13 is best shown in FIG. 2. The upper component 26 of the receiver 13 is an essentially planar member which angles upwardly away from the lid 31 to which it is attached, with a longitudinally extending notch 35 which receives the rib 20 of the latch top segment 11 when the assembly 10 is in the closed position.

In FIG. 2 there is shown the position of the latch assembly 10 when the assembly is in place on the container 14 and securing the lid 31 of such container 14. In dashed lines of FIG. 2 there is shown the open position with the latch top segment 11a having been released from the receiver 13 and pulled downwardly to the fully open position in order to release the latch assembly 10 and thus allow the container 14 to be opened.

As can be seen from the drawings taken in conjunction with the foregoing description, the latch assembly may be assembled by first snapping the pin 19 of the latch top segment 11 in place within the slots 24 of the latch bottom segment 12. The pin 23 of the latch bottom segment 12 is then snapped in place within the arcuate slot 27 of the latch receiver 13 which has been previously molded to the side wall 30 and lid 31 of the container 14.

To close the latch 10, the lower end of the bottom segment 12 may be manually pivoted outwardly and upwardly to a point which allows the top segment 11 to be affixed with its rib 20 engaged over the notch 35 of the upper component 26 of the receiver 13. The bottom segment 12 is then pivoted downwardly to a vertical position with the result that the latch assembly 10 assumes the locked or closed position. The assembly 10 may be released by pivoting the bottom segment 12 upwardly, releasing the tight engagement of the rib 20 with the notch 35 and allowing the top segment 11 to be pivoted downwardly to the position shown as 11*a* in FIG. 2, with the result that the lid 31 may then be opened.

As will be understood from the previous description, the present latch assembly 10 may be completely injection molded and no separate pins or rivets are required to assemble the operating members. In addition, no pins or rivets are required to attach the assembly 10 to the tackle box or other container.

It is thought that the invention and many of its attendant advantages will be understood from the foregoing description, and it will be apparent that various changes may be made in the form, construction and arrangement of the parts without departing from the spirit and scope of the invention or sacrificing its material advantages, the forms hereinbefore described being merely the preferred embodiments thereof.

The embodiments of the invention in which an exclusive property or privilege is claimed are defined as follows:

1. A latch assembly for releasably fastening a cover on a container having side walls, comprising:

a latch receiver having a lower component which is integrally molded to a side wall of said container and an upper component which is integrally molded to the cover adjacent said side wall, said lower component having a longitudinally extending arcuate slot which opens downardly, and said upper component including a planar member which angles upwardly away from the cover and having a notch at the outer edge of the top portion of said planar member;

b. a latch top segment having a planar base portion with a pair of side flanges and a top flange attached thereto and extending at right angles to said base; a longitudinal rib member attached to the top flange and extending downwardly at an angle away from the base, said rib releasably engaging the notch of said latch receiver when the latch assembly is in the closed position, the side flanges having extensions which project beyond said base portion at the end opposite to said top flange, a pin member located between said flange extensions and having one end thereof molded integrally with each of said flange extensions; and c. a latch bottom segment having a planar base portion with a pair of side flanges attached thereto and extending at right angles to said base of the bottom segment, the side flanges having extensions which project beyond said base of the bottom segment at one end thereof, a pin member located between said flange extensions of the bottom segment and having one end thereof molded integrally with each of said flange extensions of the bottom segment, said pin member of the latch bottom segment being received within the arcuate slot of said latch receiver, an arcuate slot provided at the midportion of the inner edge of each side flange of the bottom segment, said arcuate slots of the side flanges receiving the pin member of said latch top segment;

each of said arcuate slots of said latch receiver and said latch bottom segment being shaped so as to encircle the respective pin to an extent sufficient to hold it in place while being discontinuous to an extent sufficient to allow the pin to be snapped in place within the slot, and the side flange extensions of the latch top segment projecting beyond the base of said top segment sufficiently to allow clearance for the latch bottom segment to pivot about its attachment to the pin member of said latch top segment.

2. The latch of claim 1 wherein the latch top segment and the latch bottom segment each comprise a one-piece molding of polypropylene.

* * * * *